US006891097B2

(12) United States Patent
Wilfer

(10) Patent No.: US 6,891,097 B2
(45) Date of Patent: May 10, 2005

(54) DAMPING ELEMENT

(76) Inventor: Hans-Peter Wilfer, Zum Hackerhof 5, D-08258 Markneukirchen (DE)

( * ) Notice: Subject to any disclaimer, the term of this patent is extended or adjusted under 35 U.S.C. 154(b) by 40 days.

(21) Appl. No.: 10/439,376

(22) Filed: May 15, 2003

(65) Prior Publication Data

US 2004/0154457 A1 Aug. 12, 2004

(30) Foreign Application Priority Data

Feb. 12, 2003 (EP) ..... 03003040

(51) Int. Cl.[7] ..... G10D 13/02
(52) U.S. Cl. ..... 84/411 M; 84/411 R; 84/411 P
(58) Field of Search ..... 84/411 M, 411 R, 84/411 P

(56) References Cited

U.S. PATENT DOCUMENTS 1,788,636 A * 1/1931 Russell ..... 84/318
3,653,625 A 4/1972 Plice
4,242,937 A 1/1981 Pozar
4,760,984 A * 8/1988 Hennessey ..... 248/121
5,107,741 A 4/1992 Beals et al.
5,154,381 A * 10/1992 Malinao ..... 248/178.1
6,043,420 A 3/2000 Arnold
6,121,528 A 9/2000 May

FOREIGN PATENT DOCUMENTS

GB 2305767 4/1997

* cited by examiner

*Primary Examiner*—Shih-Yung Hsieh
(74) *Attorney, Agent, or Firm*—Sidley Austin Brown & Wood, LLP

(57) ABSTRACT

A pillow-shaped damping element to be located in an interior of a percussion instrument includes upper and bottom sides, a filling material having sound-absorbing characteristics and located between the upper and bottom sides, and a holder for a microphone provided on the upper side of the damping element.

17 Claims, 3 Drawing Sheets

DAMPING ELEMENT

BACKGROUND OF THE INVENTION

1. Field of the Invention

The present invention relates to a pillow-shaped damping element to be located in an interior of a percussion instrument, in particular, a bass-drum and having upper and bottom sides spaced from each other and a filling material having sound-absorbing characteristics and filling the space between the upper and bottom sides.

2. Description of the Prior Art

Damping elements of the type described above are placed by percussionists in bass drums, primarily, on their inner bottoms. Thereby, the bass drum sound is damped, and the sound becomes drier.

In bass-drums, the sound is transmitted by a microphone. The microphone is usually received in a holder supported on a stand located in front of the drum. With such positioning of a microphone, there is a danger that a musician can trip over the microphone or its support, tearing it off. This danger is increased due to the fact that many stages for musical groups with percussion instruments are small, and movement space for a musician from the front backward is very limited.

Alternatively, instead of positioning the microphone in front of the drum, it is placed on the damping element inside the drum. A microphone, which is placed on a damping element, e.g., a pillow or a blanket adversely affects the quality of the sound in comparison with a "free-floating" microphone, i.e., with a microphone the head of which has no contact with the damping element or the drum and which is received in a holder.

Accordingly, an object of the present invention is to provide a microphone holder that would permit to transmit the sound without the microphone occupying any place on the stage.

SUMMARY OF THE INVENTION

This and other objects of the present invention, which will become apparent hereinafter, are achieved by, according to the present invention, placing or mounting the microphone holder on the upper side of the damping element which is designed for being placed in interior of a percussion instrument.

Placing the microphone holder on the upper side of a dampening element provides for the "free-floating" positioning of a microphone in the interior of a drum. Such positioning of a microphone permits to combine the advantages of a "free-floating" positioning of the microphone using a microphone holder with the advantages of placing the microphone in the interior of the drum. In this case, the holder with the microphone is not located in front of the drum, and the danger of the microphone being knocked down by a musician is eliminated. Simultaneously is eliminated an adverse effect of a microphone lying on the damping element on the transmitted sound.

According to a further development of the present invention, the microphone can be permanently or releasably secured in the holder. In the later case, the microphone can be secured in the holder and remove therefrom more rapidly.

According to an advantageous embodiment of the present invention, the microphone received in the holder can be rotated in a plane substantially parallel to the upper side of the damping element and/or pivot in a plane extending substantially perpendicular to the upper side of the damping element. This permits to align the microphone in any direction in accordance with the wishes of the musician or a sound technician.

According to a further development of the present invention, the holder can be permanently or releasably secured on the damping element. In the later case, the damping element, if needed, can be used without a microphone.

According to a still further development of the present invention, the holder position on the damping element can be permanent or variable. The later permits the musician or the sound technician to arbitrarily arrange the microphone in the interior of the drum in accordance with the specific requirements.

Advantageously, the holder includes a base place, a pin-shaped member attached to the base plate, and a holding member supported by the pin-shaped member and having a socket for receiving the microphone. Both the base plate and the pin-shaped member are formed of metal, and the socket has a cylindrical shape. The base plate can be covered with a foam material for damping purposes.

Advantageously, the pin-shaped member is permanently secured on the base plate, e.g., by welding.

According to a further advantageous embodiment of the present invention, the holding member has a first section for mounting the holding member on the pin-shaped member, and a second section carrying the socket and pivotally connected with the first section. The pivotal connection of the second section with the first section can be effected with a hinge. With such construction of the holding member, a proper alignment of a microphone, which is received in the socket, can be easily effected, in particular, in a vertical plane.

According to a further development of the present invention, a reinforcing plate is mounted on the upper side of the damping element and, advantageously, is secured thereto. The reinforcing plate extends parallel to the upper side and can be formed, e.g., of a plastic material.

The advantage of providing a reinforcing plate consists in that it is particularly suitable for mounting the microphone holder.

According to a further development of the present invention, the holder is mounted on the reinforcing plate, preferably, is secured thereto, e.g., with screws.

According to an alternative embodiment of the present invention, there is provided, on the upper side, above the reinforcing plate and in a spaced relationship thereto, an outer layer extending substantially parallel to the outer side and formed, advantageously, of a rubber-like material. The outer layer is connected with the reinforcing plate and/or the damping element at its edge region, and has an opening formed, advantageously, as a slot.

According to a particularly advantageous embodiment of the present invention, the base plate of the holder is so arranged between the outer layer and the reinforcing plate, that the pin-shaped member projects through the opening in the outer layer. Advantageously, the through-opening is so framed that the pin-shaped member can be displaced therealong, with the position of the pin-shaped member in opening being fixed, preferably, releasably fixed.

Alternatively or in addition, the pin-shaped member can have a section with an outer thread, with the holder being releasably secured at the through-opening by a first nut having an inner thread corresponding to the outer thread of the pin-shaped member. In addition or alternatively, the holding member can be provided with an inner thread corresponding to the outer thread of the pin-shaped member and with which holding member can be mounted on the pin-shaped member in an arbitrary selected rotational position and be secured in the arbitrary selected position with a second nut having an inner thread corresponding to the outer thread of the pin-shaped member.

The foregoing structure provides for positioning of the microphone holder over the outer layer with a possibility of displacement therealong, with slot-formed opening serving as a guide slot. The selected position of the holder can be fixed, e.g., with a first nut that is screwed over the threaded section of pin-shaped member until it abuts the base plate. This permits to adjust the horizontal position of the microphone. The horizontal position of the microphone can also be adjusted by adjusting the rotational position of the holding member on the pin-shaped member and securing the pin-shaped member in the selected position with a second nut by screwing the second nut on the pin-shaped member until it abuts the holding member. Advantageously, the first and second nuts are so formed and dimensioned that they can be easily screwed and unscrewed manually, without using any tool.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
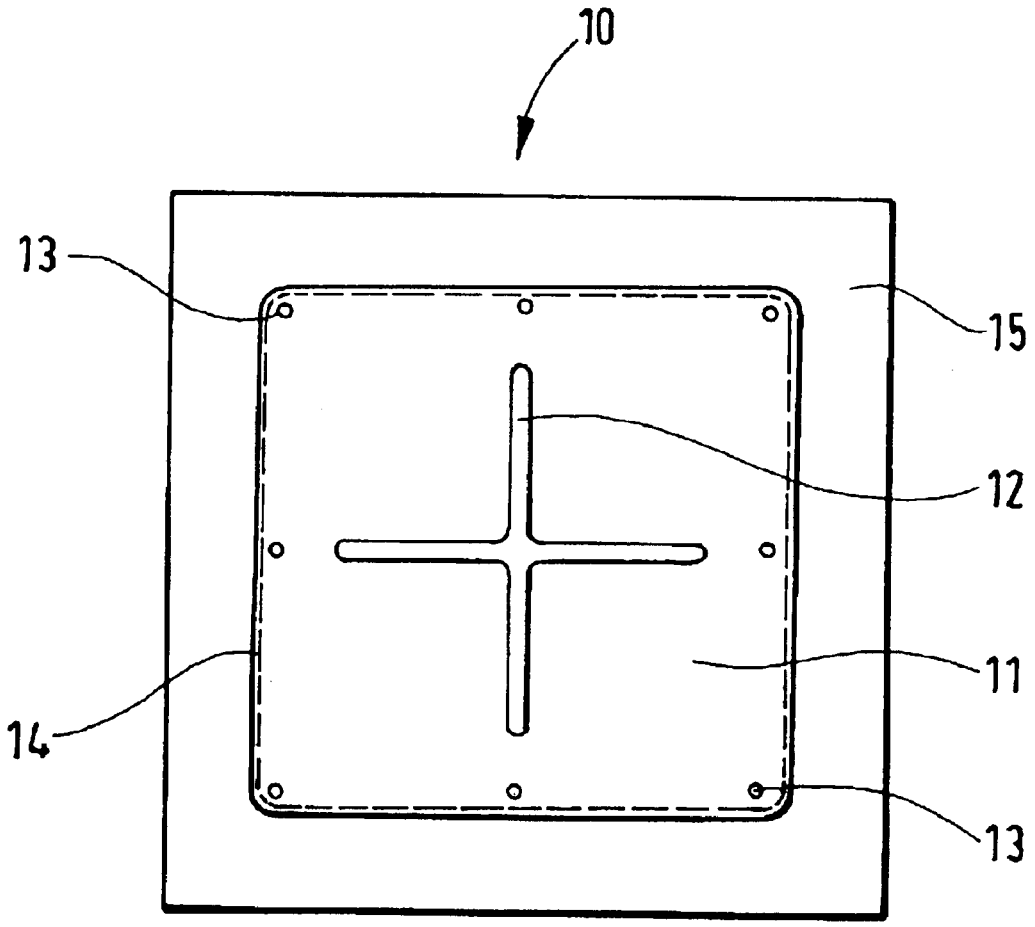
FIG. 1 a plan view of a damping element according to the present invention.

FIG. 1 shows a plan view of an upper side 15 of a damping element 10 that is formed as a pillow. On the upper side 15, there is provided an outer layer 11, which overlies a reinforcing plate 17 (not shown in FIG. 1). The outer layer 11 is formed of a rubber-like material and is secured to the upper surface 15 with a stitched seam 14. In addition, the outer layer 11 is secured to the reinforcing plate 17 with screws 13. In the outer layer 11, there is provided an opening 12 formed of two mutually crossing slots. The two slots from a guide slot for a holder 18 (not shown in FIG. 1).

Figure 2:
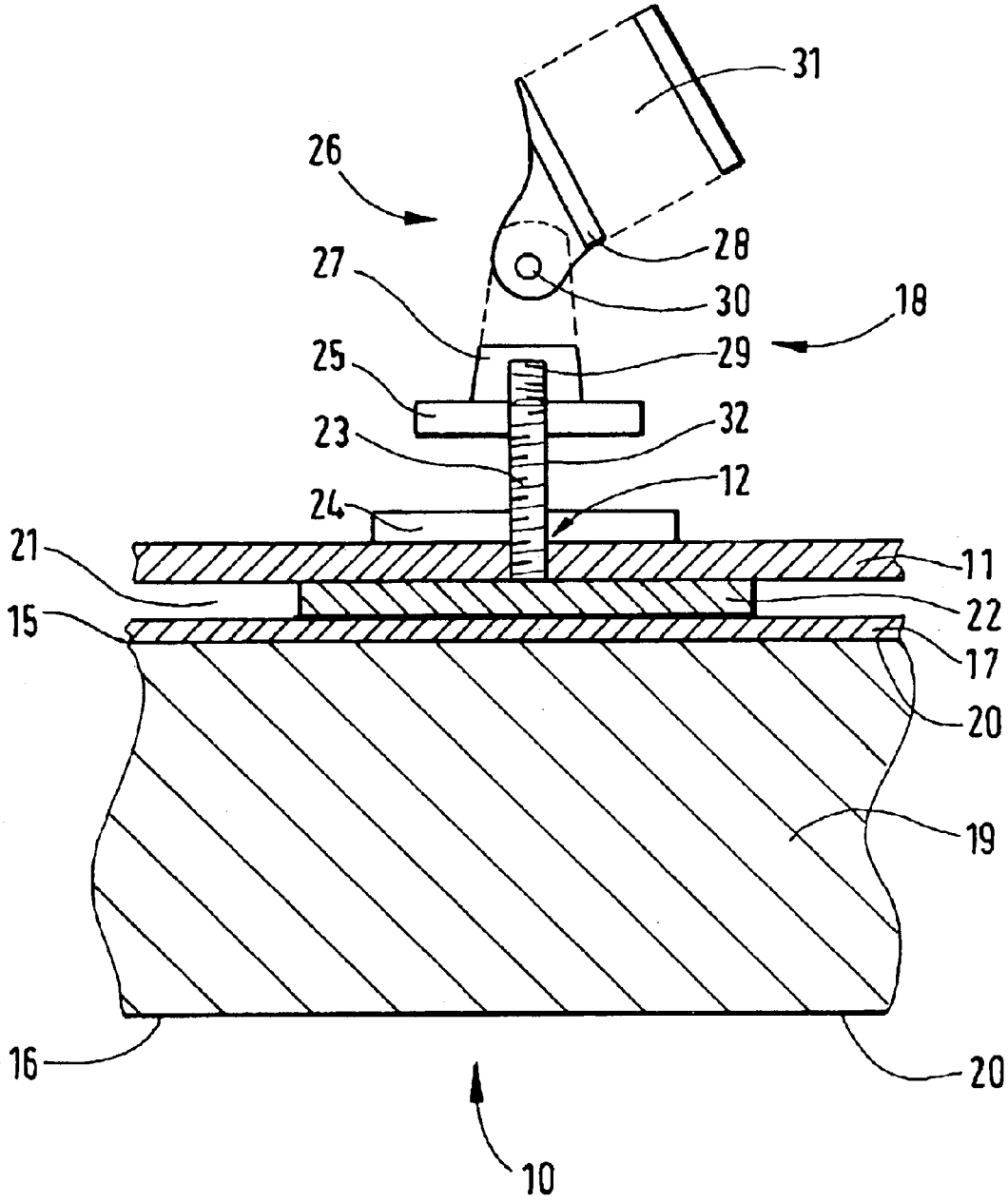
FIG. 2 a vertical cross-sectional view of the damping element shown in FIG. 1 with a microphone holder provided on its upper surface.

The holder 18, which is used for holding a microphone, is shown in detail in FIG. 2 a lower part of which shows a cross-section of the damping element 10. The interior of the damping element 10 is filled with a filling 19 consisting of sound absorbing material. The filling 19 is covered by cloth material 20, upper and lower sides of which are shown with reference numerals 15 and 16. As it has already been discussed above, on the upper side 15, the reinforcing plate 17 is arranged. The outer layer 11 is separated from the reinforcing plate 17 by a hollow space 21.

The microphone holder 18 has a base plate 22 formed, e.g., of metal and is arranged in a hollow space 21, as shown in FIG. 2. For damping the plate 22, foam material (not shown) can be provided on the bottom of the plate 22. The plate 22 is provided with a vertically extending pin-shaped number 23 that extends through the opening 12 and at least a section of which is provided with an outer thread 32. Two nuts 24, 25 with an inner thread corresponding to the outer thread 32 of the pin-shaped number 23 are mounted on the pin-shaped member 23. The holder 18 further includes a holding member 26.

The holding member 26 has a first section 27 and a second section 28. In the bottom of the first section 27, there is formed a threaded bore 29 for screwing the first section 27 onto the pin-shaped member 23. A hinge 30, which connects the upper or second section 28 with a first section 27 provides for pivotal movement of the section 28 in the vertical plane. The second section 28 has a microphone-receiving socket 31.

With the pin-shaped member 23, which supports the holding member 26 for the microphone and which extends through the opening 12, the holding member 26, together with the microphone, can be displaced along the slots forming the opening 12. The holder 18 is fixed in place by fastening the first nut 24 on the pin-shaped member 23 as shown in FIG. 2. As it is apparent from FIG. 2, the rotational position of the holding member 26 is determined by an extent the holding member 26 is screwed on the pin-shaped member 26. The holding member 26 is screwed in place by fastening the second nut 25 on the pin-shaped member 23.

The foregoing arrangement of the microphone holder 18 on the damping element 10 provides for following displacements of the microphone received in the socket 31:

- displacement in a horizontal direction by displacing the base plate 22 of the holder 18 along the guide slots which form the opening 12,
- rotation of the holding member 26 in opposite direction due to cooperation of the inner thread of the threaded bore 27 with the outer thread 32 of the pin-shaped member 23. This rotation insures an appropriate alignment of the microphone in the horizontal plane; and
- vertical displacement of the second section 28 with respect to the first section 27 of the holding member 26 due to the hinge connection of the second section 28 with the first section 27. This displacement insures an appropriate vertical alignment of the microphone.

Figure 3:
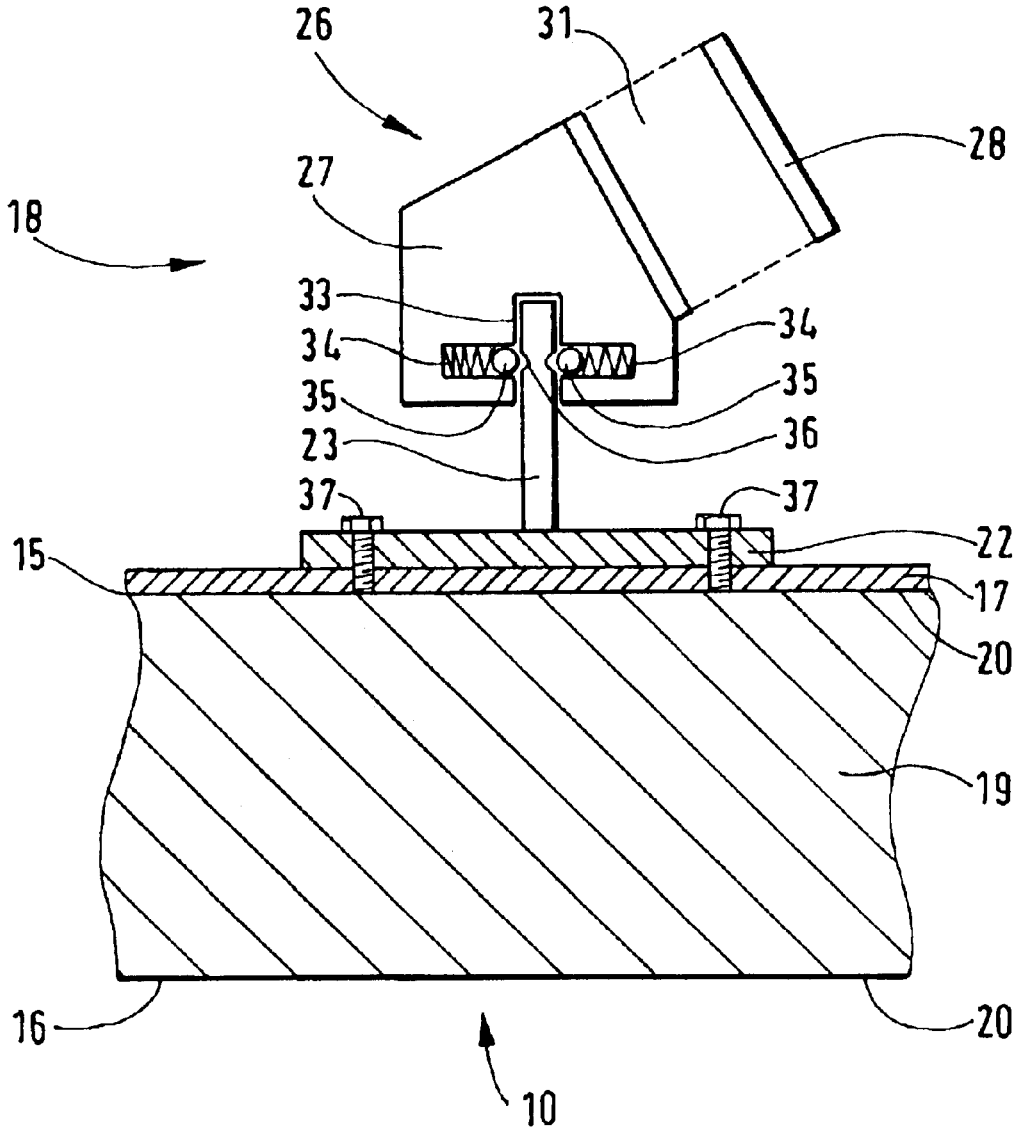
FIG. 3 a vertical cross-sectional view similar to that of FIG. 2 but with another embodiment of a microphone holder.

FIG. 3 shows another embodiment of the microphone holder 18 and its mounting on damping element 10. In FIG. 3, the elements comparable with those of FIGS. 1–2, are designated with the same reference numerals.

In FIG. 3, the drawing element 10 is identical to the damping element 10 shown in FIGS. 1–2. As in FIGS. 1–2, the damping element 10 shown in FIG. 3 has a filling 19 covered by cloth material 20, with the reinforcing plate 17 provided on the upper side 15.

As in FIGS. 1–2, the holder 18 has a base plate with a pin-shaped member 23 projecting vertically from the base plate 22. Both the base plate 22 and the pin-shaped member 23 can be formed of metal. The pin-shaped member 23 can be welded to the base plate 22. The pin-shaped member 23 has a circular cross-section and is provided in its upper portion with an annular groove 36. The holding member 26 of the holder 18, as in the embodiment of FIG. 2, is formed of first and second section 27–28. However, in distinction from the holding element 26 shown in FIG. 2, the first and second sections 27, 28 of the holding element 26 shown in FIG. 3, are fixedly connected with each other, forming an integral part. The second section 28, as in the embodiment of FIG. 2, has a microphone-receiving socket 21.

The first section 27 of the holder 18 shown in FIG. 3 has a bore 33 the dimensions of which correspond to those of the pin-shaped member 23 in such a way that the holding member 18 can be pinned on the pin-shaped member 23. The bore 33 functions as a receiving bore for the pin-shaped member 23, forming with the pin-shaped member 23, a plug-type connection. For securing the holding member 26 on the pin-shaped member 23, there is provided snap-connection means. The snap-connection means consists of two balls 35, which are located in opposite, with respect to the bore 33, grooves, and two springs 34 likewise arranged in respective opposite grooves for biasing the respective balls 35 toward the bore 33. Upon pinning of the holding member 26 onto the pin-shaped member 23, the balls 35 engage in the annular groove 36 of the pin-shaped member 23. The snap-connection means (34, 35) secure the holding member 26 in a vertical position with respect to the base plate 22. However, upon application of an appropriate pulling force, the holding member 23 can be taken off the pin-shaped member 23. Due to the circular cross-section of the pin-shaped member 23 and of the groove 36, the holding element 26 can be rotated in a plane parallel to the base plate 22.

In the embodiment shown in FIG. 3, the holder 18 is directly secured on the reinforcing plate 17 of the damping element 10 with screws 37. To provide for a flexible positioning of the holder 18 on the reinforcing plate 17, the reinforcing plate 17 can be provided with a plurality of arbitrary arranged threaded through-bores (not shown).

Separate components and connections shown in FIGS. 1 through 3, can be arbitrary connected with each other. Thus, in the holder 18 shown in FIG. 3, the first and second sections 27, 28 of the holding member 26 can be hingedly connected by a hinge 30, as shown in FIG. 2, instead of being fixedly connected with each other. Reversely, in the holding member 26 shown in FIG. 2, the first and second sections 27, 28 can be fixedly connected with each other. Further, the snap-connection means of FIG. 3 can be used for mounting the holding member 26 on the pin-shaped member 23 in the embodiment shown in FIG. 2, and a threaded connection can be used for mounting the holding member 26 on the pin-shaped member 23 in the embodiment shown in FIG. 3. The same applies to mounting of the base plate 22 on the reinforcing plate 17 of the damping element 10.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A pillow-shaped damping element to be located in an interior of a percussion instrument, comprising upper and bottom sides; at least one filling material having sound-absorbing characteristics and located between the upper and bottom sides; a holder for a microphone secured on the upper side of the damping element and a reinforcing plate mounted on the upper side of the damping element.

2. A damping element according to claim 1, wherein the microphone holder comprises means for receiving the microphone.

3. A damping element according to claim 1, further comprising means providing for at least one of rotation of the microphone received in the holder in a plane substantially parallel to the upper side of the damping element and a pivotal movement of the microphone in a plane extending substantially perpendicular to the upper side of the damping element.

4. A damping element according to claim 1, wherein a position, in which the holder is secured to the upper side of the damping element is one of permanent and variable.

5. A damping element according to claim 1, wherein the holder comprises a base plate; a pin-shaped member attached to the base plate; and a holding member supported by the pin-shaped member and having a socket for receiving the microphone.

6. A damping element according to claim 5, wherein both the base plate and the pin-shaped member are formed of metal, and wherein the socket has a cylindrical shape.

7. A damping element according to claim 5, wherein the pin-shaped member is permanently attached to the base plate.

8. A damping element according to claim 5, wherein the pin-shaped member is releasably attached to the base plate by using one of plug-in connection, snap-connection, and thread connection.

9. A damping element according to claim 5, wherein the holding member has a first section for mounting the holding member on the pin-shaped member, and a second section pivotally connected with the first section and carrying the socket.

10. A damping element according to claim 1, wherein the reinforcing plate is made of a plastic material and is fixedly secured to the upper side of the damping element.

11. A damping element according to claim 1, wherein the holder is secured to the reinforcing plate.

12. A damping element according to claim 11, comprising screw means for securing the holder to the reinforcing plate.

13. A damping element according to claim 1, further comprising an outer layer extending substantially parallel to the upper side of the damping element and spaced from the reinforcing plate, whereby a hollow space is formed there between.

14. A damping element according to claim 13, wherein the outer layer is formed of a rubber-like material, has an edge region connected with at least one of the reinforcing plate and the damping element, and has a through-opening.

15. A damping element according to claim 14, wherein the through-opening is formed as a slot.

16. A damping element according to claim 14, wherein the holder has a pin-shaped member extending into the through-opening and releasably secured therein in an arbitrary selected position, with a major portion of the pin-shaped member extending above the opening.

17. A damping element according to claim 16, wherein the pin-shaped member has a section with an outer thread, wherein the holder is releasably secured at the through-opening by a first nut having an inner thread corresponding to the outer thread of the pin-shaped member, and wherein the holder has a holding member having an inner thread corresponding to the outer thread of the pin-shaped member and with which the holding member is being mounted on the pin-shaped member in an arbitrary selected position and is secured in the arbitrary selected position with a second nut having an inner thread corresponding to the outer thread of the pin-shaped member.

* * * * *